US010283836B2

(12) United States Patent
Sierzenga et al.

(10) Patent No.: US 10,283,836 B2
(45) Date of Patent: May 7, 2019

(54) INTEGRATED ANTENNA UNIT HOOK, HANG EJECT-INJECT INSTALLATION SYSTEM

(71) Applicant: AMPHENOL ANTENNA SOLUTIONS, INC., Rockford, IL (US)

(72) Inventors: Jeffrey Sierzenga, Conover, NC (US); Jimmy Ho, Hickory, NC (US); Chengcheng Tang, Stanley, NC (US); Eric Brian Berry, Connelly Springs, NC (US); Jeffery Jie Liu, The Hague (NL); Justin Riek, Taylorsville, NC (US)

(73) Assignee: Amphenol Antenna Solutions, Inc., Rockford, IL (US)

( * ) Notice: Subject to any disclaimer, the term of this patent is extended or adjusted under 35 U.S.C. 154(b) by 129 days.

(21) Appl. No.: 15/360,112

(22) Filed: Nov. 23, 2016

(65) Prior Publication Data

US 2017/0149115 A1 May 25, 2017

Related U.S. Application Data

(60) Provisional application No. 62/259,963, filed on Nov. 25, 2015.

(51) Int. Cl.

| | |
|---|---|
| ***H01Q 1/12*** | (2006.01) |
| ***H01Q 1/20*** | (2006.01) |
| ***H01Q 1/24*** | (2006.01) |
| ***H01Q 1/42*** | (2006.01) |

(52) U.S. Cl.
CPC ..... *H01Q 1/1228* (2013.01); *H01Q 1/20* (2013.01); *H01Q 1/246* (2013.01); *H01Q 1/42* (2013.01); *H01Q 1/1207* (2013.01)

(58) Field of Classification Search
CPC ... H01Q 1/1228; H01Q 1/246; H01R 2201/02
USPC ..... 343/892
See application file for complete search history.

(56) References Cited

U.S. PATENT DOCUMENTS

| | | | | |
|---|---|---|---|---|
| 2009/0207094 | A1* | 8/2009 | Yang | H01Q 1/125 343/904 |
| 2014/0179244 | A1* | 6/2014 | Colapietro | H04B 1/40 455/90.2 |
| 2016/0099745 | A1 | 4/2016 | Ho et al. | |
| 2016/0119796 | A1 | 4/2016 | Ho et al. | |
| 2016/0365618 | A1* | 12/2016 | Kim | H01Q 1/1207 |

* cited by examiner

*Primary Examiner* — Ricardo Magallanes
(74) *Attorney, Agent, or Firm* — Blank Rome LLP

(57) ABSTRACT

An antenna system having a quick release that removably and reliably connects a Remote Radio Unit (RRU) to an Integrated Antenna Unit (IAU), both mechanically and electronically. The RRU has an RRU connector and the antenna has an antenna connector that removably engages with and mates with the RRU connector. The system has a temporary hanging position that enables a user to connect additional electronic connections to the RRU before it is fully coupled with the antenna.

16 Claims, 12 Drawing Sheets

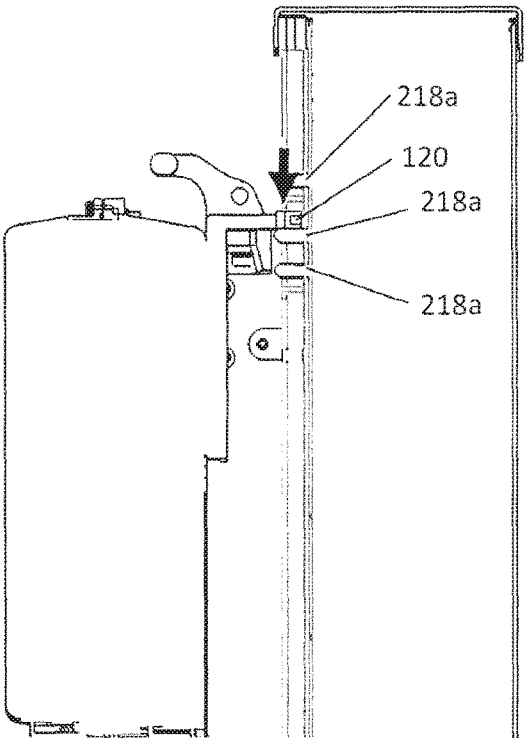
Figure 6(a)
Figure 6(b)
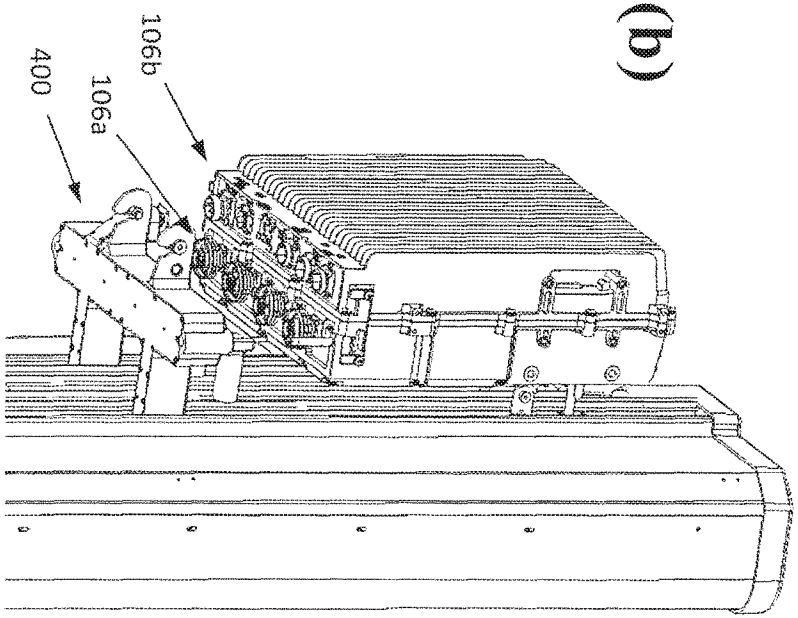

INTEGRATED ANTENNA UNIT HOOK, HANG EJECT-INJECT INSTALLATION SYSTEM

RELATED APPLICATIONS

This application claims the benefit of U.S. Provisional Application No. 62/259,963, filed Nov. 25, 2015, the entire contents of which are incorporated herein by reference.

BACKGROUND OF THE INVENTION

Field of the Invention

The invention relates to mechanical functions of antenna systems. More specifically, the invention relates to mechanical features used on integrated antenna units which aid in installation and removal of remote radio units or similar components attached to antennas.

Background of the Related Art

Currently, wireless service providers assemble antenna systems, such as an Integrated Antenna Unit (IAU), at ground level. That assembly includes attaching Remote Radio Units (RRU) and associated hardware to a pole or structure, which requires connecting cable assemblies and associated components at ground level. Once the system is raised and installed on tower/structure, any changes that may be needed, such as servicing and/or changing remote radio units, requires the service provider to lower the unit to the ground level before connections are changed or adjusted. Current systems do not provide a way to perform these functions while installed in the raised position.

Integrated antenna units and remote radio units are shown and described, for instance, in Patent Publication Nos. US2016/0099745 and 2016/0119796, both of which are assigned to the current assignee. Those applications are hereby incorporated by reference.

SUMMARY OF THE INVENTION

Therefore a need exists for antenna systems to have mechanisms that conveniently and safely support installation and removal of antenna related devices while installed on the tower/structure. The present invention permits remote radio units or similar devices to be safely temporarily hung or suspended onto an antenna. This allows the service provider to attach cables/connectors (such as Common Public Radio Interface (CPRI) cables/connectors) to remote radio units or similar components prior to final installation while on tower/structure.

Accordingly, it is an object of the invention to provide an antenna system that can be easily serviced and replaced while installed on a tower or other structure. It is a further object of the invention to provide an antenna system in which an RRU can be easily removed and replaced from an IAU.

In accordance with these and other objectives, the invention is an antenna unit system, such as an IAU, that connects with a radio unit, such as an RRU. The IAU has a docking station that receives the RRU. A mechanical tab is attached to remote radio unit or similar device which into back of antenna body, permitting RRU to hang/suspend above the docking station prior to full installation. This creates clearance and visibility to allow the installer to attach CPRI cable and connectors before the RRU is fully engaged with docking station on the IAU. A mechanical handle(s) is attached to the RRU that assists lowering RRU into docking station and further injecting/compressing the RRU into the docking station. When removing the RRU from the docking station, pressing the handle(s) upwards assists in ejecting/removing the RRU from the docking station through a cam and follower configuration.

Multiple eyelets are included in the antenna docking station and mounting hardware to provide anchor points to attach carabiners or equivalent clamping with tensile wire with features which can be tethered to the RRU or related devices. That provides protection from falling or means to manipulate the antenna system while installing or removal.

These and other objects of the invention, as well as many of the intended advantages thereof, will become more readily apparent when reference is made to the following description, taken in conjunction with the accompanying drawings.

BRIEF DESCRIPTION OF THE FIGURES

FIG. 4(*b*) shows the quick release mechanism in an opened or unconnected position;

FIGS. 6(*a*) and 6(*b*) are views of the RRU in a hanging position on the antenna;

FIG. 7(*b*) is a side view of the antenna and attached RRUs and mounted pole;

FIG. 8(*b*) is a side isometric view showing RRU attached (fully docked) into the docking station with the quick release mechanism substantially horizontal, pressing down and injecting the RRU.

DETAILED DESCRIPTION OF THE PREFERRED EMBODIMENTS

Figure 1:
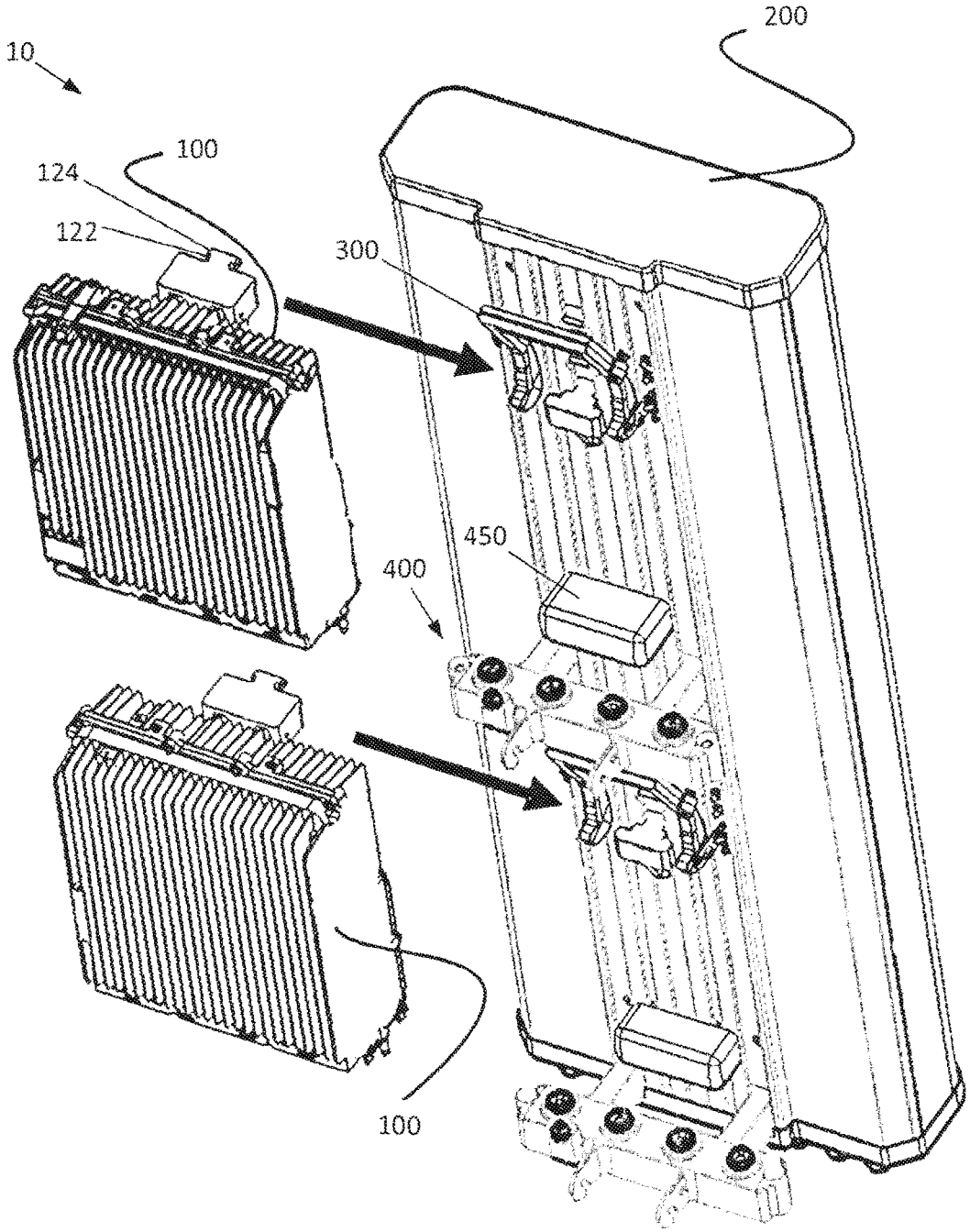
FIG. 1 is a disconnected isometric view of integrated antenna system with docking stations, quick release mechanism, and remote radio units (RRU)

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents that operate in similar manner to accomplish a similar purpose. Several preferred embodiments of the invention are described for illustrative purposes, it being understood that the invention may be embodied in other forms not specifically shown in the drawings.

Turning to the drawings, FIG. 1 shows the antenna system comprising an integrated antenna unit 10 in accordance with an illustrative, non-limiting embodiment of the invention.

Figure 2:
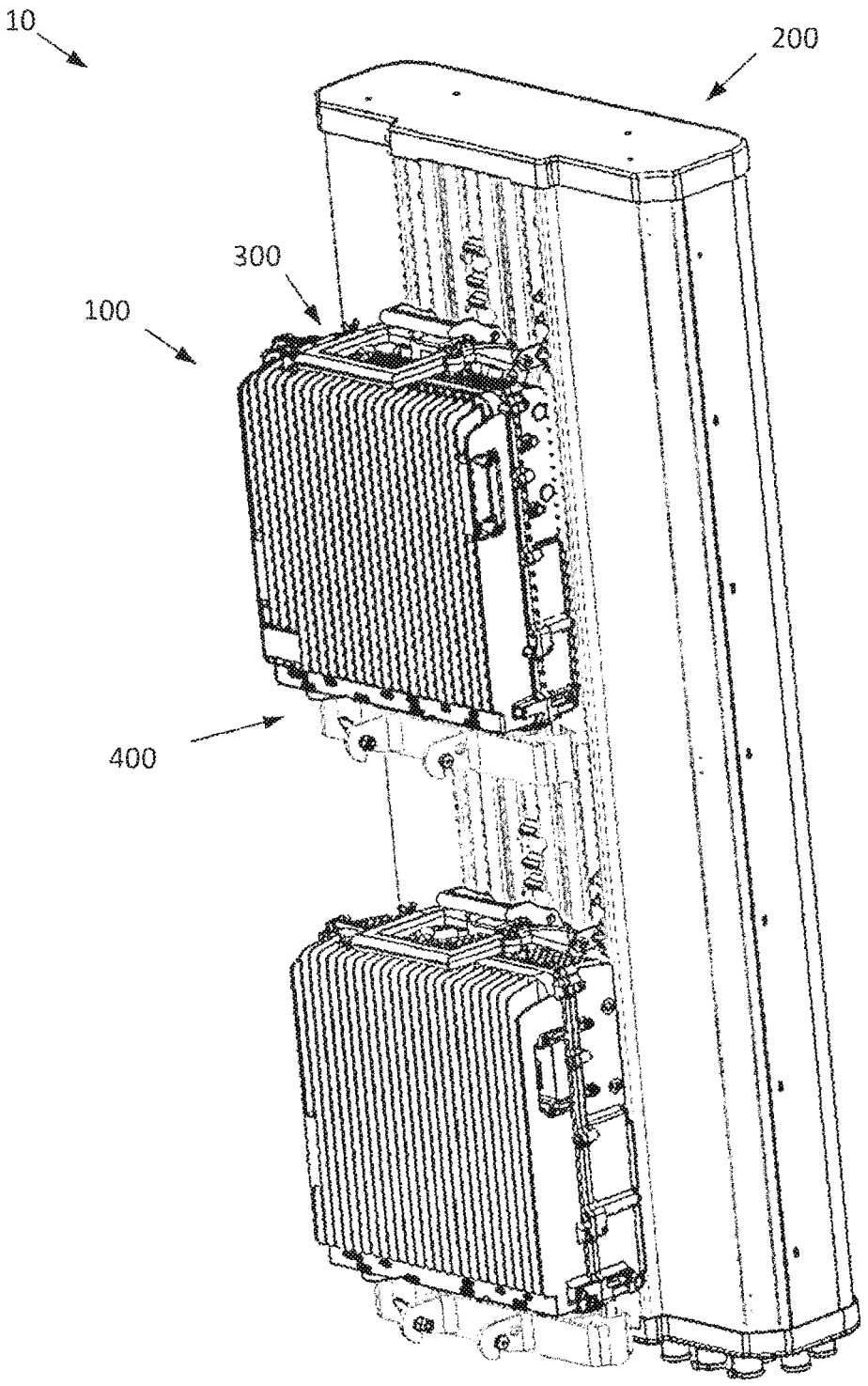
FIG. 2 is a perspective view of the antenna system of FIG. 1 with the RRUs coupled to the antenna and docking stations.

The antenna system 10 includes an electronic component 100 (an RRU in the illustrated embodiment), an antenna structure or antenna 200, a quick release assembly 300, and a docking station 400. As shown in FIGS. 1, 2, the quick release assembly 300 removably and reliably couples the RRU 100 to the antenna 200. In FIG. 1, the RRU 100 is mechanically and electronically separate from the antenna 200, and in FIG. 2 the RRU 100 is mechanically and electronically coupled to the antenna 200.

Figure 3:
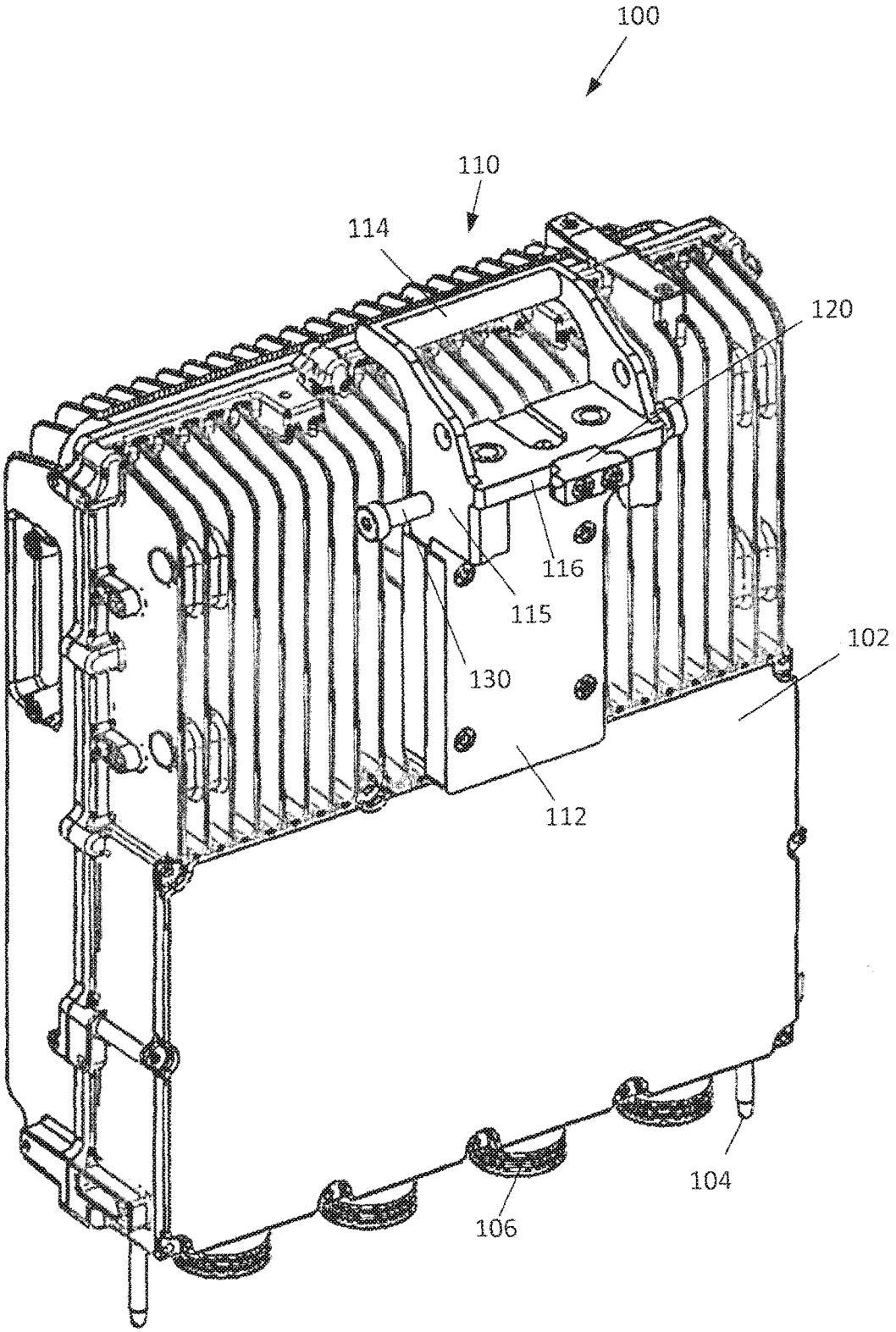
FIG. 3 is a perspective view of the RRU having an RRU connector assembly.

Referring to FIG. 3, the RRU 100 is shown in greater detail. Here, the RRU 100 has a main body 102 and an RRU connector assembly 110. The main body 102 can house electronic components and has electronic connectors 106 that electronic couple the RRU electronics to external devices such as the antenna 200, CPRI cables or connectors carried by the antenna 200, or other electronic components. In the current exemplary embodiment, the connectors 106 mate with respective connectors located on the docking station 400. The main body 102 is substantially square-shaped with a front (or front side or front surface), back or rear (or rear side or rear surface), and four sides (top, bottom, left and right), but can have any suitable shape.

The RRU connector assembly 110 is connected to the rear and top side of the main body 102 of the RRU 100. The RRU connector assembly includes a support plate 112, handle 114, side arms 115, cross-support member 116, and tab or tab portion or tab member 120. The support plate 112 is a flat plate that is connected to the rear surface of the main body 102 and provides support to the RRU connector assembly 110 to carry the weight of the RRU 100. The side arms 115 extend upward over the top side of the main body 102, and also extend inward over the top side of the main body 102 from the rear of the main body 102 to the front of the main body 102. The handle 114 extends between the two side arms 115, so that a side arm 115 is connected at the two ends of the handle 114. The handle 114 is connected to the distal ends of the side arms 115. The user can grab the handle 114 to lift, grab, push or otherwise manipulate the RRU 100. The support plate 112 is connected to the proximal ends of the side arms 115.

The cross-support member 116 is also connected between the two side arms 115 between the proximal and distal ends of the side arms 115. The cross-support member 116 can have a flat surface to form a platform that projects outward substantially perpendicular to the rear face of the main body 102 of the RRU 100. The cross-support member 116 can be located, for example, at the rear of the main body 102, for example at the top of the main body rear at the corner of the rear and the top side of the main body 102. In addition, a pin 130 is provided in each of the side arms 115, or a single pin 130 can extend through both side arms 115. The pin(s) 130 project outward from the respective side arm 115 and slidably engage the quick release mechanism 300. The pin(s) 130 provide leverage for the quick release mechanism 300 to move the RRU 100 when the quick release mechanism 300 is moved, as will be described in further detail below.

The tab 120 projects outward and rearward from the cross-support member 116 and can be located, for example, in the center of the cross-support member 116. Thus, the tab 120 is the furthest outwardmost point of the RRU 100. Guide pins 104 are provided on the bottom of the main body 104 to guide and align the RRU 100 into connection with the docking station 400; and more particularly to guide and align the connectors 106 with the connectors of the docking station 400. As best shown in FIG. 1, the tab 120 can have a narrow neck 122 and a widened head 124 to form a channel or slot between the wings of the widened head 124 and the cross-support member 116.

Figure 4A:
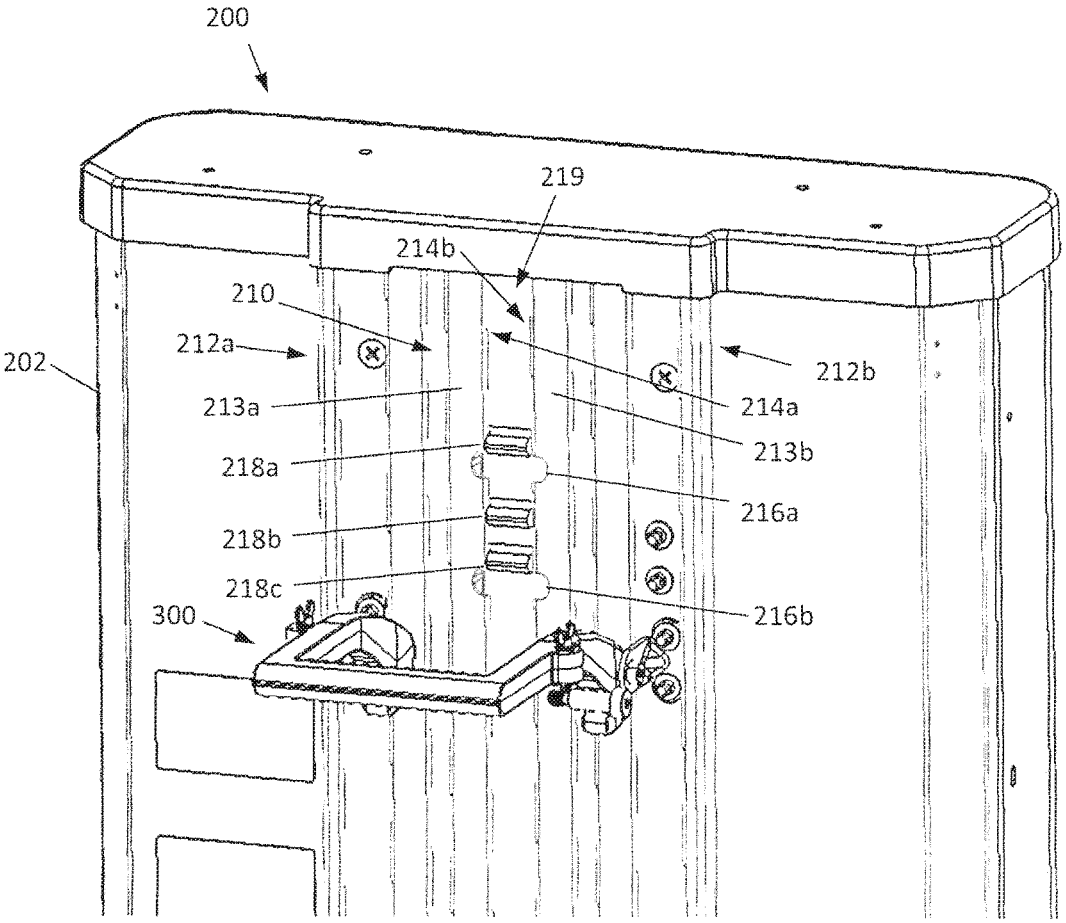
FIG. 4(*a*) is a view of the antenna having an antenna connector assembly and quick release mechanism.
Figure 4B:
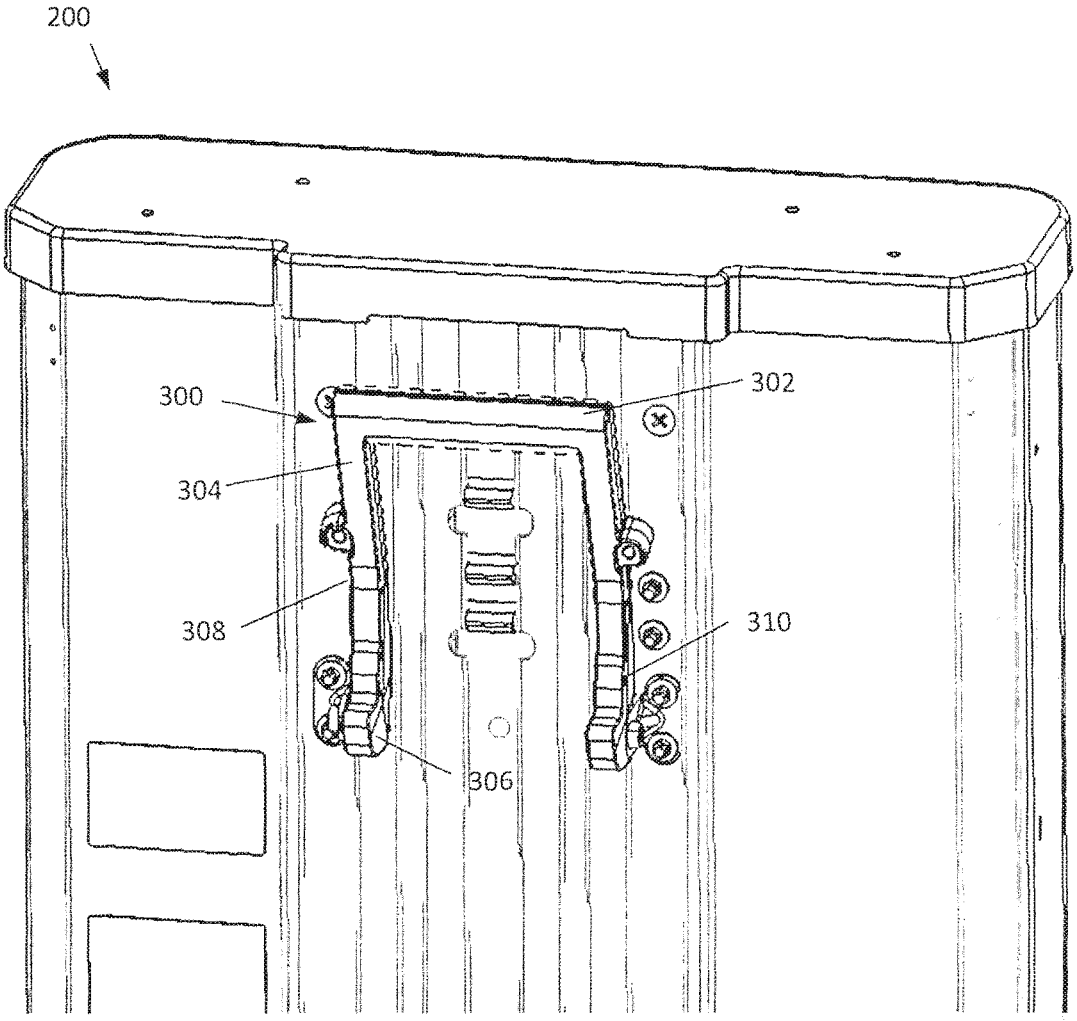
Figure 9:
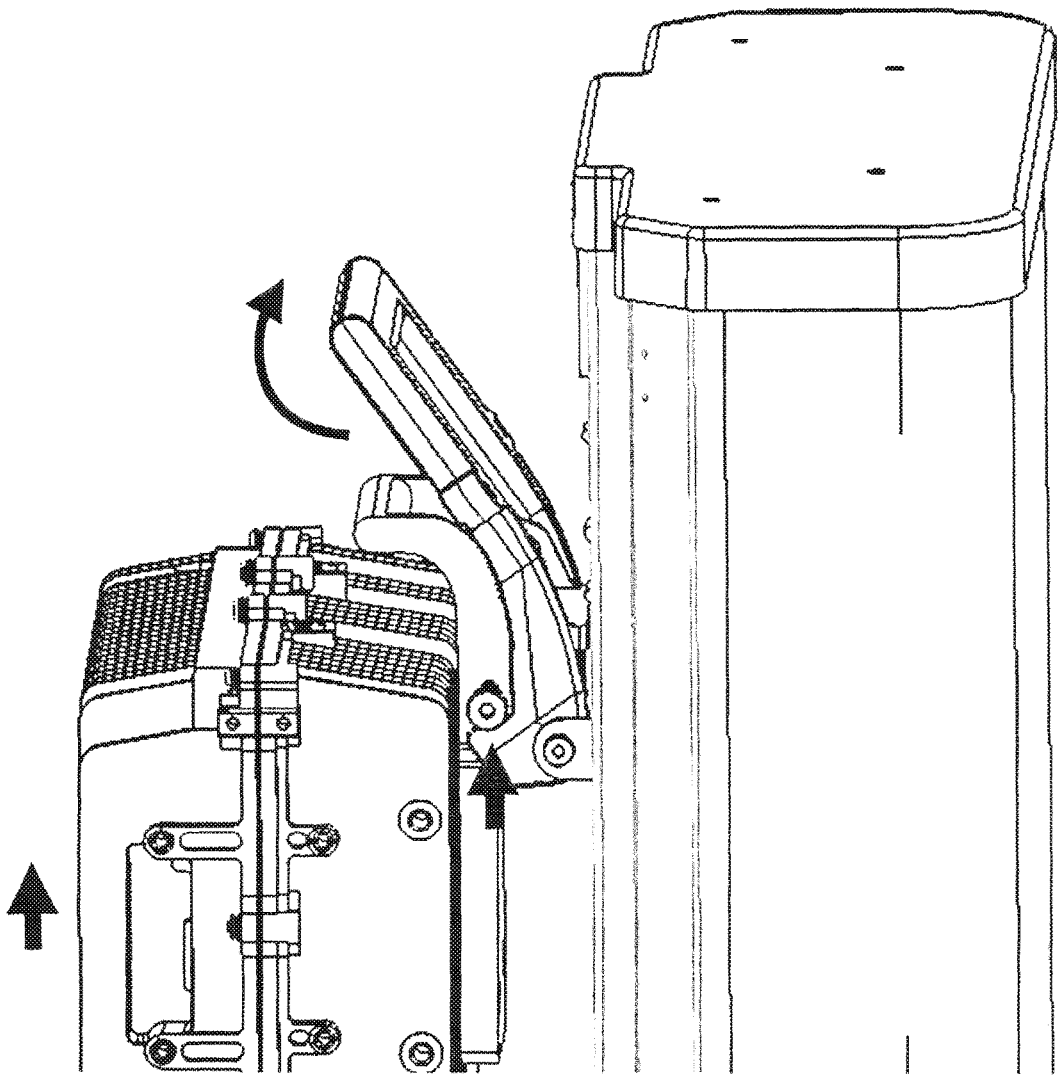
FIG. 9 is a side isometric view showing removal of the RRU from the docking station with the quick release mechanism pushing up and ejecting the RRU.

Turning to FIG. 4(*a*), details of the antenna 200 are shown. The antenna 200 has a main body 202 and an antenna connector assembly 210. The antenna connector assembly 210 can be formed integral with the main body 202 or separate components that are connected to the main body 202. The antenna connector assembly 210 includes a connector plates 212*a*, 212*b* that extend along the length of the antenna body 202. In the embodiment shown, the antenna body 202 is elongated with a longitudinal axis. And as shown in FIG. 9, the connector plates 212 can project outward from the main body 202 of the antenna 200. The connector plates 212*a*, 212*b* extend parallel to the longitudinal axis of the main body 202, so that the longitudinal axis of the plates 212*a*, 212*b* is parallel to the longitudinal axis of the main body 202. The plates 212*a*, 212*b* have an inner longitudinal edge portion 213*a*, 213*b* that is bent outward away from the main body 202 to form a channel 214*a*, 214*b* between the inner longitudinal edge 213*a*, 213*b* and the main body 202, respectively.

A first and second pair of notches 216*a*, 216*b* are formed or cut into the inner longitudinal edge portion 213, with the first pair of notches 216*a* at a higher position than the second pair of notches 216*a*. The first or upper pair of notches 216*a* includes a notch in each of the left and right inner longitudinal edge portions 213*a*, 213*b*, and the upper notch in the left edge portion 213*a* is aligned with the upper notch in the right edge portion 213*b*. The second or lower pair of notches 216*b* includes a notch in each of the left and right inner longitudinal edge portions 213*a*, 213*b*, and the lower notch in the left edge portion 213*a* is aligned with the lower notch in the right edge portion 213*b*. Each of the upper and lower pairs of notches 216*a*, 216*b* are wide enough to receive the wings of the tab 120. The gap 219 between the inner edge portions 213*a*, 213*b* is sufficiently large to receive and engage with the neck of the tab 120 but not the wings of the tab 120. Accordingly, the tab 120 can enter the channel 214*a*, 214*b* at the pairs of notches 216*a*, 216*b* and slide downward in the channels 214*a*, 214 to a position where the tab 120 cannot be removed because the wings of the tab 120 are larger than the gap 219. Thus, the tabs 120 can only be removed from the channel 214*a*, 214*b* when it is aligned with the notch pairs 216*a*, 216*b*.

In addition, one or more stops or stop members 218*a*, 218*b*, 218*c* are provided in the gap 219 to prevent the tab 120 and RRU 100 from sliding further in the channels 214*a*, 214*b*. The stop members 218 can project outward from the body of said antenna 200. Thus, the user can removably engage the RRU 100 to the antenna 200 by aligning the tab 120 with a pair of notches 216*a*, 216*b* and pushing the tab 120 into the channels 214*a*, 214*b*. The user can then allow the RRU 100 to slide down in the channels 214*a*, 214*b* until it reaches a stop member 218*a*, 218*b*, or 218*c*. The RRU 100 can then hang at that position until ready to remove the RRU 100 by raising it to align the tab 120 with the pair of notches 216*a*, 216*b* and pulling the RRU 100 outward out of the channels 214*a*, 214*b*.

Figure 8A:
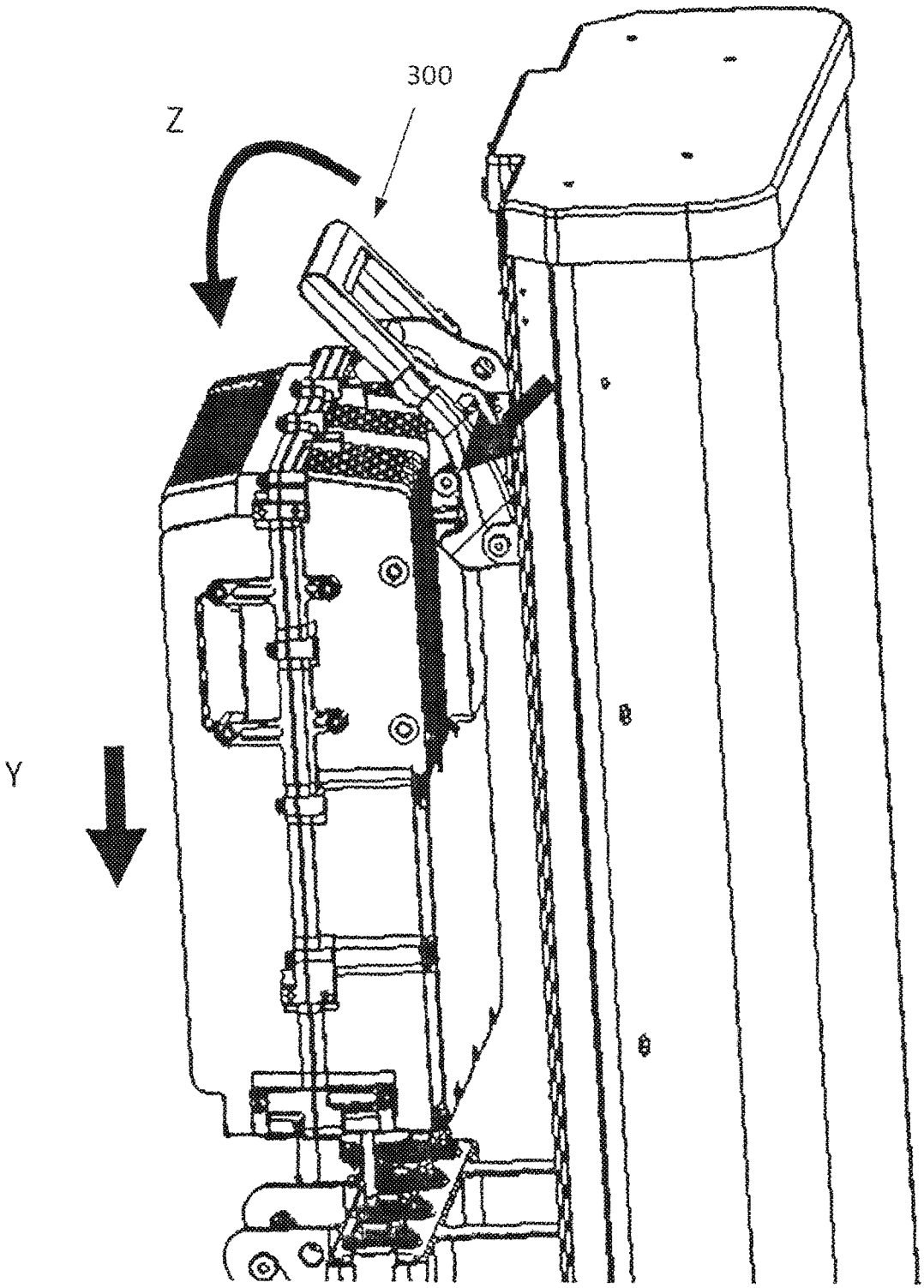
FIG. 8(*a*) is a side isometric view showing RRU being attached to the docking station by the quick release mechanism rotating counter-clock wise pressing down on the operating pin of the RRU.
Figure 8B:
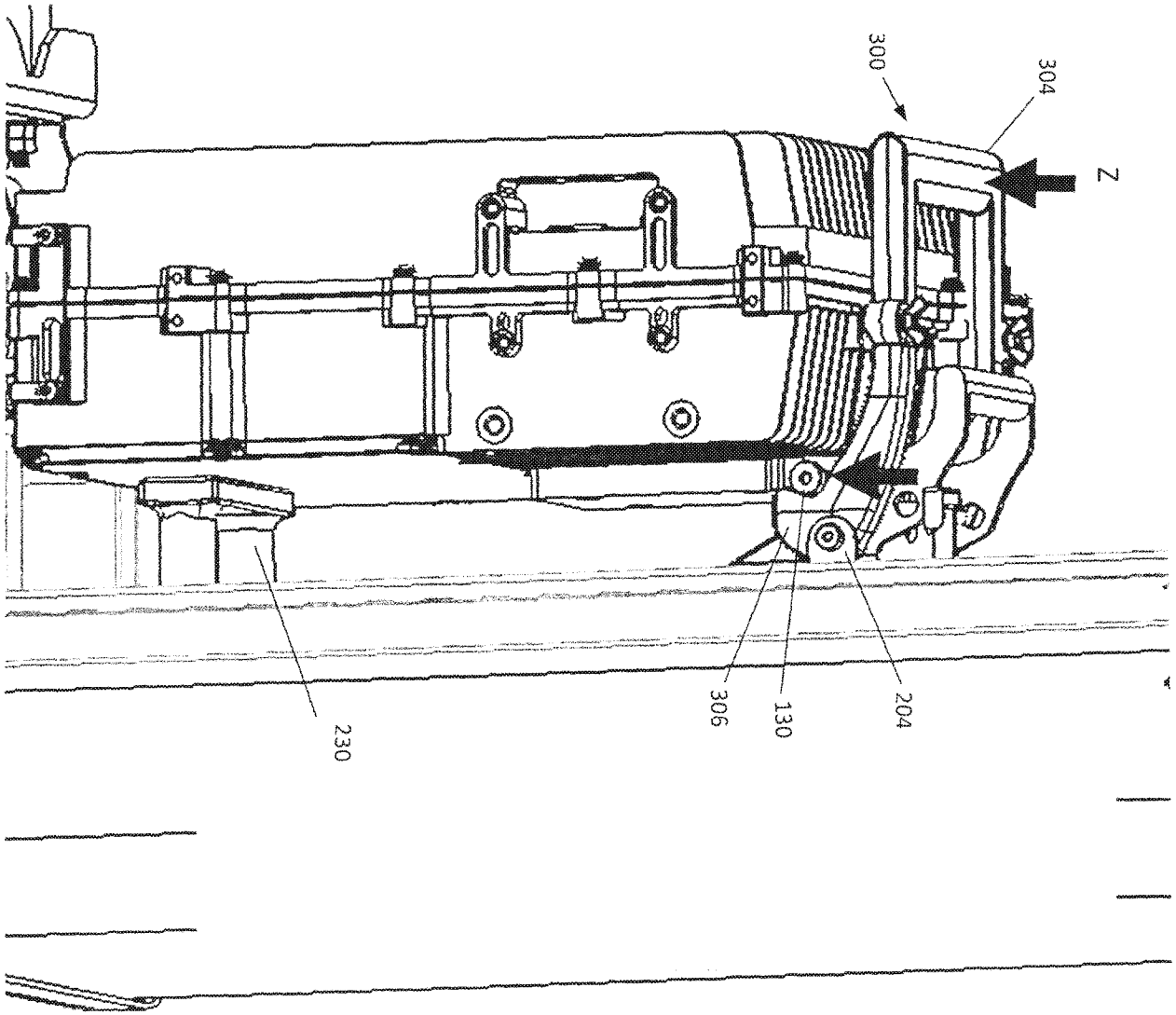

Turning to FIGS. 4(*a*) and 4(*b*), the quick release assembly 300 is shown in a non-limiting example of the invention. The quick release assembly 300 has two arms 304, and a handle 302. The arms 304 are elongated and extend substantially parallel to the longitudinal axis of the antenna 200, and the handle is elongated and extends between the two arms 304 substantially transverse to the longitudinal axis of the antenna 200. The arms 304 are curved outward away from the main body 202 of the antenna 200. As best shown in FIG. 8(*b*), the arm has a proximal portion that is rotatably connected the antenna body 202, such as for example by a pin or the like that extends through the proximal portion of each arm 304 and through a tab 204 that projects outward from the antenna body 202. In addition, the arms 304 have an intermediate portion that is narrower than the proximal portion, forming a ledge 306 therebetween. The ledge 306 forms a stop against which the operating pin 130 of the RRU connector assembly 110 rests.

In addition, as shown in FIGS. 8(*a*), 8(*b*), the operating pin 130 can slide along the bottom (or outer) edge of at least a part of the intermediate portion of the arms 304. When the quick release mechanism 300 is in the downward locked position, as shown for example in FIG. 8(*b*), the operating pin 130 rests against the ledge 306. In that locked position, the RRU 100 is locked to the antenna 200. When the quick release mechanism 300 is in the upward unlocked position, as shown for example in FIG. 8(*a*), the operating pin 130 is further up along the arms 304. The operating pin 130 slides along the outer edge of the arms 304 as the user moves the quick release mechanism 300 between the locked (FIG. 8(*b*)) and unlocked (FIG. 8(*a*)) positions. Returning to FIG. 4(*b*), a small groove 308, 310 can be provided at each position on the outer edge of the arms 304 to retain the operating pin 130 in that position until moved by the user.

Turning now to FIG. 6(*b*), the docking station 400 is shown. The docking station 400 is connected to and extends outward from the front surface of the antenna body 202. The docking station 400 has a top surface that faces upward in the embodiment of FIG. 6(*b*). One or more connectors are positioned on the top surface that align with and couple with the RF connectors 106*a* of the RRU 100. In addition, guide slots are placed in the docking station 400. The guide slots receive the guide pins 104 of the RRU 100. The guide slots and guide pins 104 cooperate to align the RRU connectors 106*a* with the docking station connectors when the RRU 100 is lowered downward to connect the RRU 100 to the docking station 400.

Figure 5A:
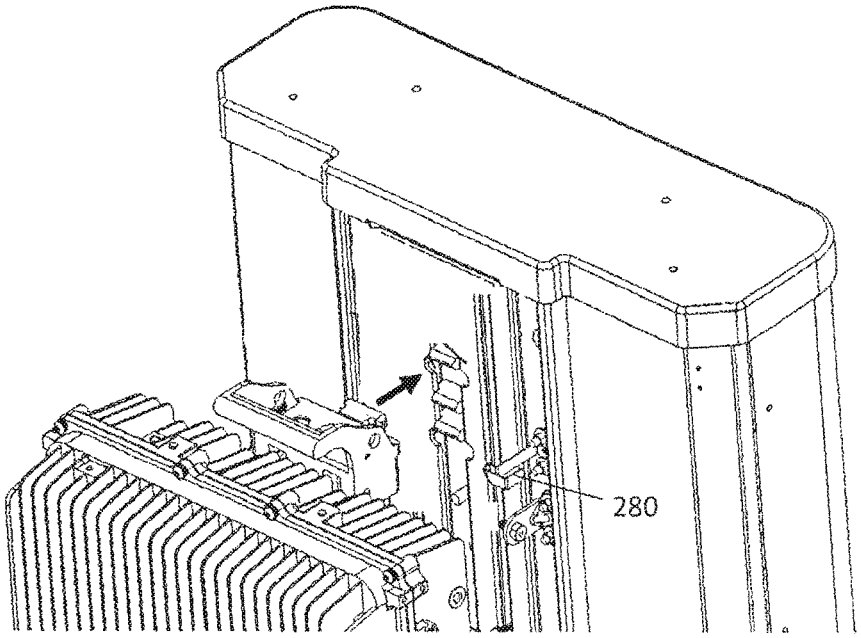
FIGS. 5(*a*) and 5(*b*) are views of the RRU connector assembly being connected to the antenna connector assembly.
Figure 5B:
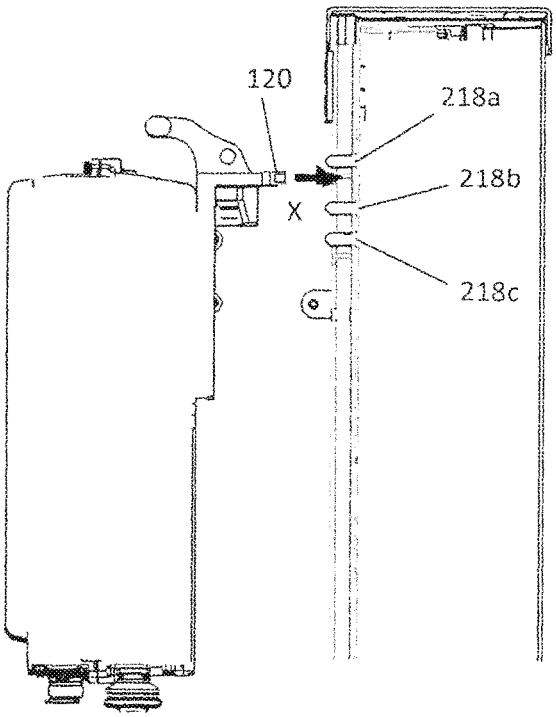

Operation of the system 10 will now be described. Beginning with FIG. 4(*b*), the user places the handle 302 of the quick release mechanism 300 in the upright or unlocked position. Turning to FIGS. 5(*a*) and 5(*b*), the user holds the RRU 100, such as by the handle 114, and aligns the tab 130 with the upper pair of notches 216*a*. The user pushes the tab 130 inward in the direction of arrow X into the upper pair of notches 216*a*, and allows the RRU 100 to slide downward in the channel until it reaches the stop member 218*b*, at which point it comes to rest. The upper stop member 218*a* prevents the user from inadvertently pushing the RRU 100 upward in the channel, and the lowest stop member 218*c* reinforces the middle stop member 218*b* and further ensures that the RRU 100 does not slide further down.

At this point, the user can release the RRU 100 and the RRU 100 will hang in the upper position against the stop member 218*b*, as best shown in FIGS. 6(*a*), 6(*b*). As shown in FIG. 8(*b*), an insulative (e.g., plastic or neoprene) rest or support member 230 can be affixed to the antenna body 202 and project outward. The RRU 100 can press against the support member to keep the RRU 100 aligned in a substantially vertical position and prevent the RRU 100 from contacting the antenna body 202 and possibly becoming damaged. Returning to FIGS. 6(*a*), 6(*b*), the RRU 100 is in the hanging position. In that position, the bottom of the RRU 100 is readily accessible to the user. The user can easily access the connectors 106. As illustrated in FIG. 6(*b*), the connectors 106 include RF connectors 106*a* and CPRI connector ports 106*b*. The RF connectors 106*a* plug into respective connectors in the docking station 400. The connector ports 106*b* can connect with various other features, such as signal cables, plugs, power cables, or fiber optics. With the RRU 100 in the upper hanging position, the user can make any necessary connections to the connector ports 106*b*. Both of the user's hands are free (since the user need not hold the RRU 100, which can be heavy), so the user can readily make the connections to the connector ports 106*b*.

Once the connections are made to the ports 106*b*, the user then moves the RRU 100 into the lower or connect position. Referring back to FIG. 5(*a*), the user raises the RRU 100 to align with the upper notches 216*a*, and removes the RRU 100 from the upper notches 216*a*. The user then moves the RRU 100 to the lower notches 216*b* by aligning the tab 130 of the RRU 100 with the lower notches 216*b* and pushing the RRU 100 and tab 130 into the lower notches 216*b*. The tab 130 and RRU 100 slide down in the channels 214, as shown by arrow Y in FIG. 8(*a*), and the rear of the RRU 100 may come into contact with the rest member 230. As shown, the guide pins 104 align with and enter respective slots in the docking station 400. As the user continues to lower the RRU 100, the connectors 106*a* engage and couple with respective connectors on the top surface of the docking station 400.

Once the RRU 100 is fully lowered by the user, it is mated with the docking station 400, and connects both mechanically and electronically (via the connectors 106*a*) to the docking station 400. In FIG. 8(*a*), the user lowers the RRU 100 until it comes to rest on the arm ledges 306. In that position, the connectors 106*a* can be partially mated to the docking station connectors, though not fully engaged. The user must push down on the quick release mechanism handle 302 for the connectors 106*a* to fully engage and mate with the docking station connectors. Thus, in FIG. 8(*b*), the user can then fully engage the connectors 106*a* and lock the RRU 100 in position by moving the quick release mechanism 300 downward, as shown by the arrow Z. As the user pushes down on the handle 302 of the quick release assembly 300, the inward edge of the handle arms 304 push downward on the operating pin 130 to force the RRU 100 downward. In the locked position of FIG. 8(*b*), the quick release assembly 300 is in the full downward position over the top of the RRU 100. The RRU 100 is electronically connected to the docking station 400 via the connectors 106*a*, and to the cables via ports 106*b*. The RRU 100 is locked to the docking station 400 and the antenna 200 and cannot come free, except by the user raising the quick release assembly 300.

Turning to FIG. 9, once the user is ready to remove the RRU 100 from the antenna 200 and docking station 400, the user lifts the handle 302 of the quick release assembly 300. As the user raises the handle 302, the ledge 306 raises the operating pin 130 to lift the RRU 100 away from the docking station 400. That action can electronically disconnect the RRU 100 from the docking station 400 by disconnecting the connectors 106*a* from the docking station 400. The user can then remove the RRU 100 from the antenna 200 by aligning the tab with the lower notches. The user can then place the RRU 100 into the hanging position by inserting the tab into the upper notches, and disconnect the cables and other electrical connections made to the ports 106*b*. The user can them remove the RRU 100 from the antenna 200 via the upper notches, and replace the RRU 100 with a new RRU 100.

Figure 7A:
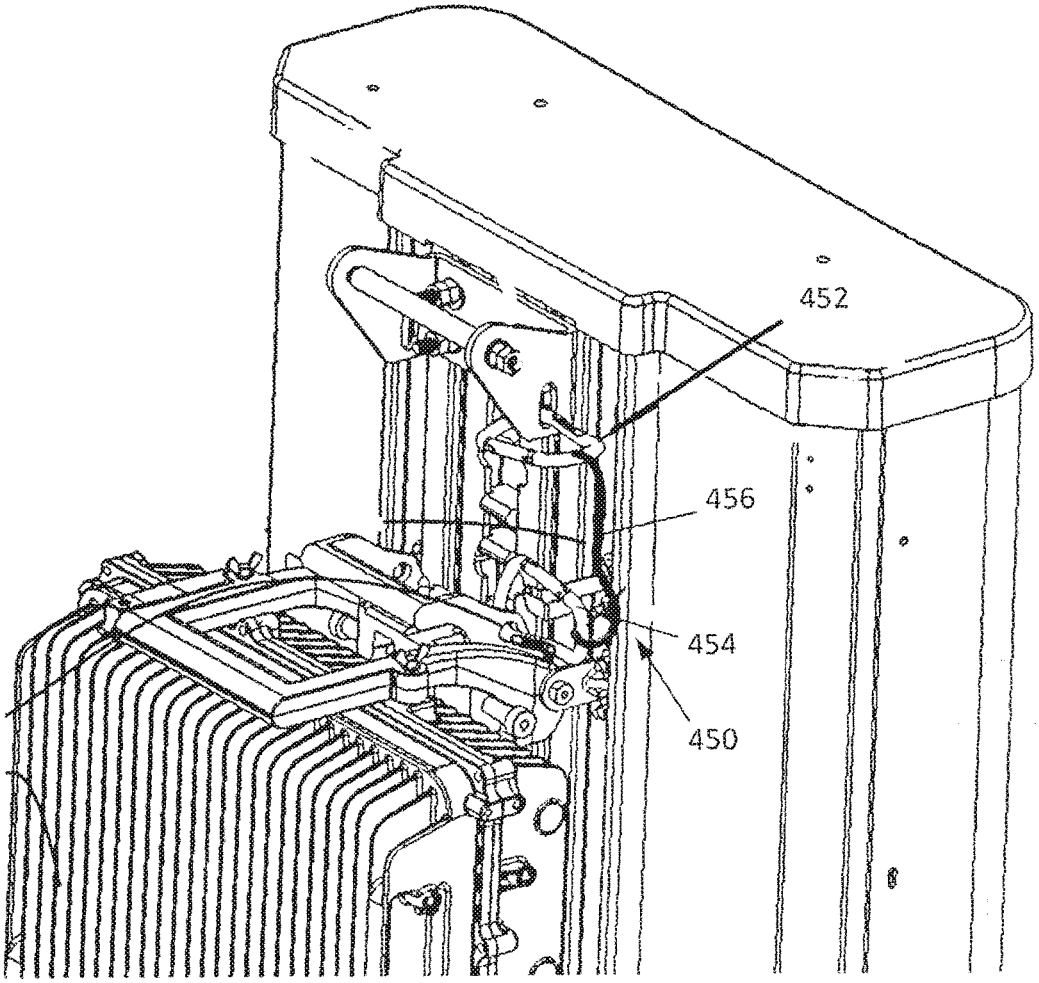
FIG. 7(*a*) is a view of the safety harness used with the antenna and RRU.
Figure 7B:
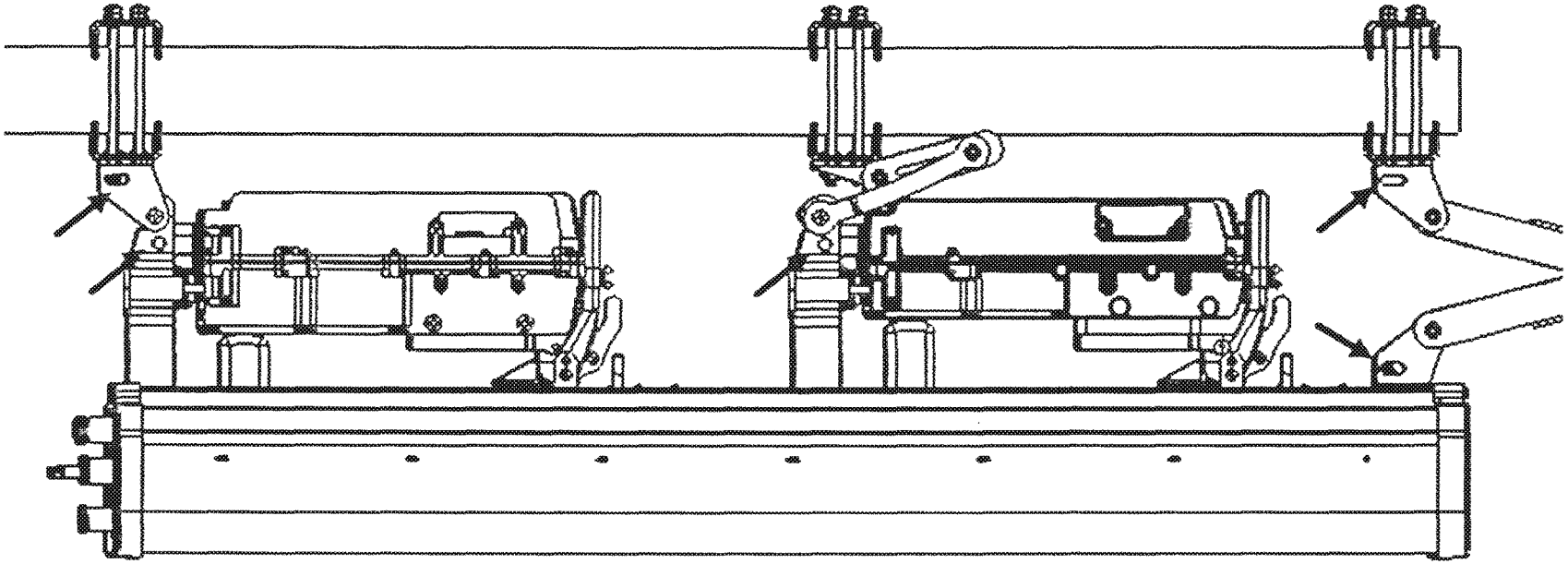

Turning back to FIG. 7(*a*), a safety harness 450 is shown. The harness 450 can have two carabiners 452, 454 connected together by a safety cable 456. The user can connect one carabiner 452 to an opening in the RRU 100, such as on the RRU connector assembly 110. For example, the RRU 100 can have an opening in one or both of the side arms 115 that receives the carabiner 452. The other carabiner 454 can connect to the antenna 200 or to a fixture connected to or integrated with the antenna, such as shown in FIG. 7(*a*). When the carabiners 452, 454 are connected, the safety harness 450 will prevent the RRU 100 from falling if the user inadvertently loses hold of the RRU 100. The user can connect the safety harness 450 before hanging the RRU 100 in the upper notches 216*a*, after hanging the RRU 100 in the upper notches 216*a*, or after connecting the RRU 100 to the docking station 400. FIG. 7(*b*) is a side view of the antenna and attached RRUs and mounted pole. Arrows indicate exemplary mounting eyelets that can be used for attaching a carabiner and/or tensile wire or the like, to secure the RRU 100 to the antenna 200.

In addition, as shown in FIG. 5(*a*), a spring clip 280 can be attached to the antenna main body 202. The spring clip 280 extends outward from the antenna main body 202 and is configured to clip onto the RRU 100 when the RRU 100 is coupled to the antenna 200. The spring clip 280 can exert enough force to prevent the RRU 100 from inadvertently coming free of the antenna 200, but still allow the user to remove the RRU 100 from the antenna 200.

As further shown in FIG. 2, the connector plates 212 can extend a portion of or the entire length of the antenna body 202. One or multiple RRUs 100 can be connected to a single antenna 200. When multiple RRUs 100 are provided, they can be arranged vertically on the antenna 200, as shown and/or horizontally or offset between adjacent antennas 200. And while the illustrated embodiments show the antenna 200 as extending vertically, the invention can be utilized on an antenna or other electronic device that extends horizontally, and the connector plates 212 can either extend vertically or horizontally.

It is noted that in the example embodiment of FIGS. 1-9, the system of the invention is shown to provide a quick and reliable removable connection between the RRU 100 and an antenna 200. It should be recognized that the invention can be utilized to mechanically and/or electronically couple any electronic components other than an RRU 100 and an antenna 200.

In addition, the invention generally includes a first electronic component (e.g., RRU 100) having a first connector (e.g., connector assembly 110 and particularly tab 130), a second electronic component (e.g., antenna 200) having a second connector (e.g., connector assembly 210), where the first electronic component can be quickly and reliably mechanically connected to the second electronic component. And simultaneously electronically coupled to the second electronic component. And where a quick release mechanism (e.g., mechanism 300) can facilitate the connections and releasably lock the first electronic component to the second electronic component. And where the system has a temporary hanging position that enables a user to connect additional electronic connections to the first electronic component.

Still further it is noted that the first connector removably and slidably couples with the second connector. In the embodiment shown and described, the first connector is a connector assembly 110 that has a tab 130, and the second connector is a connector assembly 210 having plates 212, channel 214 and gap 219. It should be apparent that any suitable connection can be provided between the first electronic component and the second electronic component, other than the specific connectors of the exemplary embodiment. And, one or both of the first and second electronic components need not be electronic or include electronics, but can be housing or the like.

It is further noted that the description uses several geometric or relational terms, such as tapered, stepped, parallel, perpendicular, and flat. In addition, the description uses several directional or positioning terms and the like, such as top, bottom, left, right, up, down, inner, raise, lower, outer, distal, and proximal. Those terms are merely for convenience to facilitate the description based on the embodiments shown in the figures. Those terms are not intended to limit the invention. Thus, it should be recognized that the invention can be described in other ways without those geometric, relational, directional or positioning terms. In addition, the geometric or relational terms may not be exact. For instance, walls may not be exactly perpendicular or parallel to one another but still be considered to be substantially perpendicular or parallel because of, for example, roughness of surfaces, tolerances allowed in manufacturing, etc. And, other suitable geometries and relationships can be provided without departing from the spirit and scope of the invention.

The foregoing description and drawings should be considered as illustrative only of the principles of the invention. The invention may be configured in a variety of shapes and sizes and is not intended to be limited by the preferred embodiment. Numerous applications of the invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

The invention claimed is:

1. An antenna system comprising:

an antenna unit having an antenna housing, said antenna housing comprising:

a first plate having a first inner edge portion bent outward from said antenna housing to form a first channel between said first inner edge portion and said antenna housing, said first inner edge portion having a first edge;

a second plate having a second inner edge portion bent outward from said antenna housing to form a second channel between said second inner edge portion and said antenna housing, said second inner edge portion having a second edge, wherein said second edge is separated from said first edge by a first gap;

a first notch in the first edge; and a second notch in the second edge, said second notch aligned with the first notch; and a radio unit having a radio housing with a front and rear, and a tab projecting outward from the rear of said radio housing, said tab comprising a narrow neck portion and an enlarged head portion, wherein the head of said tab is removably received in the first and second notches and slidably engaged with the first and second channels.

2. The antenna system of claim 1, wherein the narrow neck portion of said tab is connected to the rear of said housing.

3. The antenna system of claim 1, said radio unit further having a handle.

4. The antenna system of claim 1, said radio unit further having a connector assembly, said connector assembly having a support plate attached to the rear of said housing, two arm portions extending from said support plate each having a distal end, a handle attached at the distal ends of said two arm portions, and a platform attached to said two arm portions, wherein said tab is coupled to said platform.

5. The antenna system of claim 1, said antenna unit further comprising a first stop member positioned in the gap to prevent said tab from sliding further in said first and second channels, said stop member defining a hang position of said radio unit.

6. The antenna system of claim 5, wherein said radio unit further having a bottom with one or more connectors, whereby when said radio unit in the hang position, the one or more connectors are accessible.

7. The antenna system of claim 5, said antenna unit further comprising a second stop member positioned in the gap and offset from said first stop member prevent said tab from sliding further in said first and second channels, said stop member defining a connect position of said radio unit.

8. The antenna system of claim 7, said antenna unit further having a docking station, wherein said docking station is mechanically and/or electronically connected to said radio unit when said radio unit is in the connect position and mechanically and/or electronically disconnected from said radio unit when said radio unit is in the hanging position.

9. The antenna system of claim 1, wherein said first and second edges are linear and substantially parallel to each other.

10. The antenna system of claim 1, wherein said antenna housing is elongated with a longitudinal axis, and said first and second edges are substantially parallel to the longitudinal axis.

11. The antenna system of claim 1, wherein the neck of said tab is slidably received in the first gap and the head of said tab is slidably received in the first and second channels.

12. The antenna system of claim 1, wherein said first gap has a first distance and the first and second notches define an enlarged gap having a second gap with a second distance larger than the first distance, wherein the head of said tab is smaller than the second distance but larger than the first distance and the neck of said tab is smaller than the first distance to slidably lock the tab within the first gap and removably receive the head of said tab at the second gap.

13. The antenna system of claim 1, said antenna housing further comprising a third notch in the first edge and a fourth notch in the second edge, said third notch aligned with the fourth notch and offset from said first and second notches.

14. An antenna system comprising:

a first electronic component having a first mating connector comprising one or more channels formed in said first electronic component, said first electronic component having a docking station with one or more first electrical connectors;

first and second stop members coupled to said first electronic component at the one or more channels to define a first fixed position and a second fixed position; and a second electronic component having a second mating connector comprising a tab member slidably received in said one or more channels of said first mating connector, said second electronic component further having one or more second electrical connectors, and one or more third electrical connectors, wherein said first and second mating connectors releasably and slidably engage said first component with said second component at the first fixed position at which said docking station is mechanically disconnected from said second electronic component and said one or more second electrical connectors are accessible, and the second fixed position at which said docking station is mechanically and electrically connected to said second electronic component and said one or more second electronical connectors are inaccessible.

15. The antenna system of claim 14, further comprising a quick release locking mechanism to releasably lock said first and second electronic components in the second fixed position.

16. The antenna system of claim 15, wherein said first electronic component comprises an antenna unit and said second electronic component comprises a radio unit.

* * * * *